US009151456B2

(12) United States Patent
Bitton et al.

(10) Patent No.: US 9,151,456 B2
(45) Date of Patent: Oct. 6, 2015

(54) HOUSING ATTACHING DEVICES AND ASSEMBLIES

(75) Inventors: Jacques Bitton, Toronto (CA); Antonio Zitoli, Richmond Hill (CA)

(73) Assignee: Eurofase Inc., Richmond Hill (CA)

( * ) Notice: Subject to any disclaimer, the term of this patent is extended or adjusted under 35 U.S.C. 154(b) by 593 days.

(21) Appl. No.: 13/557,253

(22) Filed: Jul. 25, 2012

(65) Prior Publication Data

US 2014/0026495 A1 Jan. 30, 2014

(51) Int. Cl.

| | |
|---|---|
| ***F21V 21/04*** | (2006.01) |
| ***F21S 8/02*** | (2006.01) |
| ***F21V 21/14*** | (2006.01) |

(52) U.S. Cl.

CPC .. *F21S 8/02* (2013.01); *F21S 8/024* (2013.01); *F21V 21/04* (2013.01); *F21V 21/14* (2013.01)

(58) Field of Classification Search

CPC ..... F21V 21/04; F21V 21/14; F21S 8/02; F21S 8/026; F21S 8/028; F21S 8/024; F21S 8/036; F21S 8/063; E04F 12/02

USPC ..... 362/364; 248/611, 613, 619, 617

See application file for complete search history.

(56) References Cited

U.S. PATENT DOCUMENTS

| | | | | |
|---|---|---|---|---|
| 6,554,458 | B1 | 4/2003 | Benghozi | |
| 6,827,471 | B1 | 12/2004 | Benghozi | |
| 7,331,555 | B2 | 2/2008 | St-Pierre | |
| 7,456,357 | B1 | 11/2008 | Kwong et al. | |
| 8,070,328 | B1 * | 12/2011 | Knoble et al. | 362/311.02 |
| 2011/0110106 | A1 | 5/2011 | Dupuy et al. | |

* cited by examiner

*Primary Examiner* — Sharon Payne

(57) ABSTRACT

An assembly for releasably attaching a junction housing to a ceiling panel for a recessed lighting fixture. The assembly is in the form of a spring clamp and includes an outer section located over and movable along an outer surface of the housing when the housing is received within an opening in the panel, and an inner section movable along an inner surface of the housing when the housing is received within the opening in the panel. The inner section includes a finger-engageable element spring-biased to a locking position for locking the housing onto the panel, engageable by a user's finger to move the spring clamp to a releasing position releasing the housing for movement within the panel to a locking or releasing position with respect to the housing.

19 Claims, 10 Drawing Sheets

HOUSING ATTACHING DEVICES AND ASSEMBLIES

FIELD AND BACKGROUND OF THE INVENTION

The present invention relations to housing attaching devices and assemblies. The invention is particularly useful for attaching junction housings for recessed lighting fixtures to ceiling panels, and is therefore described below with respect to such an application, but it will be appreciated the invention could be used in other applications as well.

Junction boxes for recessed lighting fixtures are frequently attached to ceiling panels using screws, bolts, or other fastening devices, but are generally characterized by one or more of the following drawbacks: They require time, skill and experience for properly aligning the lighting fixture to the junction box and for properly aligning the fasteners with respect to the junction box and the ceiling panel. They generally also require significant time to remove the junction box from the ceiling panel for purposes of inspection, cleaning, repair or replacement. In addition, they severely limit the design and configuration of the junction box and/or lighting fixture, in order to accommodate them for application to the ceiling panel. Still further, the appearance of fasteners, when used, also detracts from the appearance of the lighting fixture particularly when it is a recessed lighting fixture in a ceiling panel.

Various constructions have been developed for overcoming or reducing these drawbacks, as shown for example in US Patent application 2011/0110106, and U.S. Pat. Nos. 7,331,555, 6,554,458, 6,827,471 and 7,456,357. However, none of these known constructions has been found entirely satisfactory in one or more of the above respects.

OBJECTS AND BRIEF SUMMARY OF THE INVENTION

An object of the present invention is to provide an attaching device, and also a junction assembly including such attaching devices, having advantages in one or more of the above respects.

According to one broad aspect of the invention, there is provided an attaching device for use in releasably attaching a housing to a wall panel, the housing being formed with an open end circumscribed by an outwardly projecting flange, the wall panel being formed with an opening sized for receiving the housing with the flange engaging an outer surface of the panel. The attaching device serves as a spring clamp and comprises an outer section to be located over, and to be movable along, an outer surface of the housing when the housing is received, with the spring clamp attached thereto, within said opening in the panel; and an inner section to be located proximate to, and to be movable along, an inner surface of the housing when the housing is received, with the spring clamp attached thereto, within said opening in the panel; said inner section including a finger-engageable element spring-biased to a locking position for locking the housing onto the panel, but engageable by a user's finger to move the spring clamp to a releasing position releasing the housing for movement within the panel to a locking or releasing position with respect to the housing.

Also described is a juncture assembly including two of such spring clamps for releasably attaching, to a ceiling panel, a lighting fixture in a recessed manner. This can be done without the use of screws, bolts or other fastening, and in a manner that does not require aligning the junction box to the ceiling or the lighting fixture to the junction box, and which does not detract from the neat external appearance of the recessed lighting fixture.

Further features and advantages of the invention will be apparent from the description below.

BRIEF DESCRIPTION OF THE DRAWINGS

The invention is herein described, by way of example only, with respect to the accompanying drawings, wherein:

FIG. 6 is an underside view of the attaching device, that is the spring clamp, of

FIG. 5;

It is to be understood that the foregoing drawings, and the description below, are provided primarily for purposes of facilitating understanding the conceptual aspects of the invention and possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

DESCRIPTION OF A PREFERRED EMBODIMENT

Overall Construction

Figure 4:
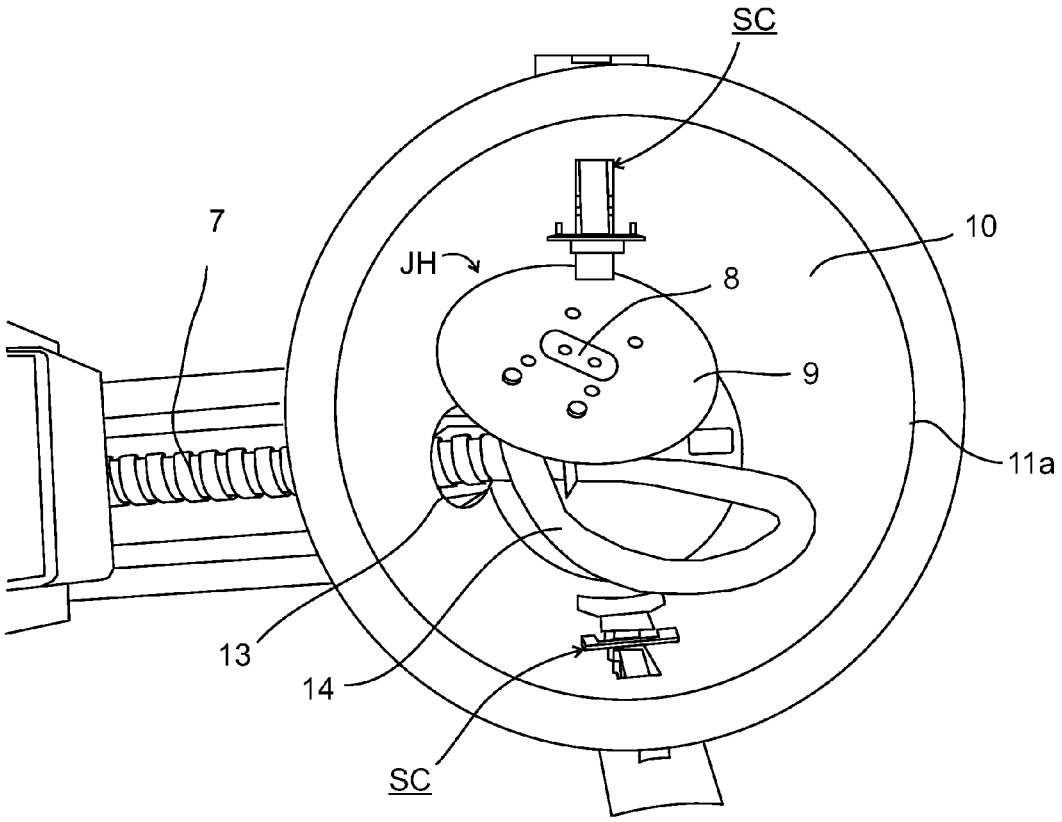
FIG. 4 is a bottom view of the junction housing of FIG. 3.
Figure 5:
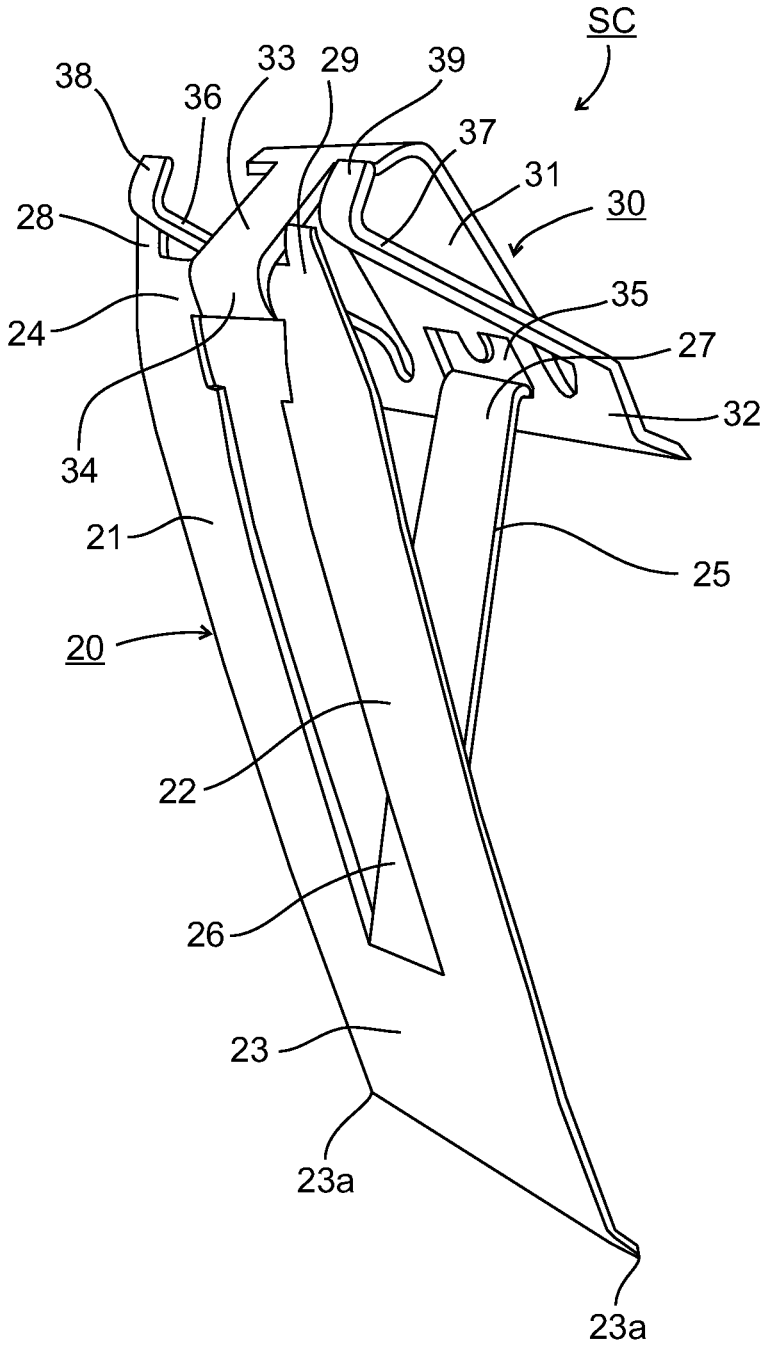
FIG. 5 is a perspective view of one of the attaching devices, namely the spring clamps, used for attaching the junction housing to the ceiling panel in FIG. 1.
Figure 6:
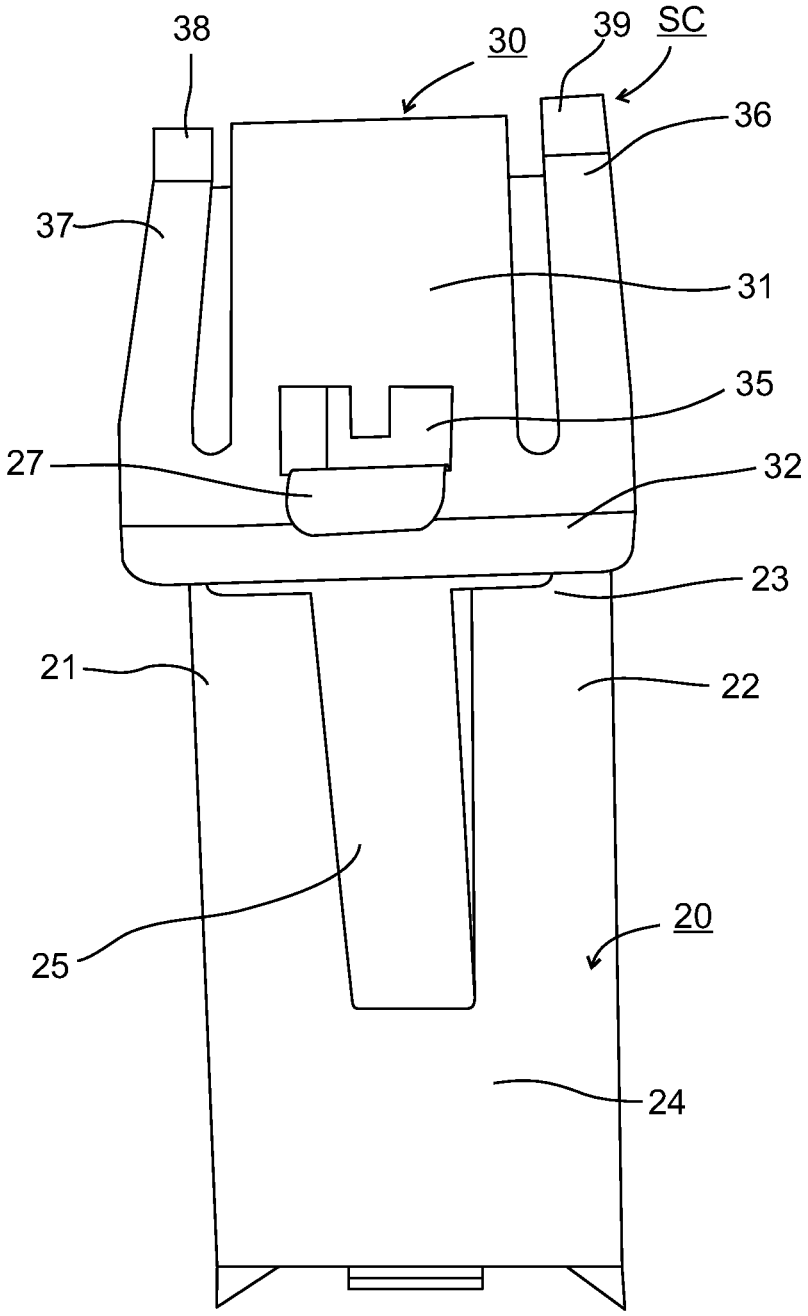

The enclosed drawings illustrate a preferred embodiment of the invention including a junction assembly, generally designated 2, for mounting a junction housing JH in an opening 3*a* (e.g., FIG. 7) in a wall panel 3 by the use of a pair of attaching devices, serving as spring clamps, each generally designated SC and shown particularly in FIGS. 5 and 6. Junction assembly 2 further includes a mounting member 4 carrying a transformer 5. The transformer 5 is connected on one side to a power supply cable (not shown) within a connection box 6 carried at one end of mounting member 4, and on the opposite side to a junction cable 14 (e.g., see FIG. 4) within an armored jacket 7 to be electrically connected to the electrical device (not shown) to be mounted within the junction housing JH. As one preferred example, wall panel 3 may be a ceiling panel, and the electrical device to be mounted within it may be a recessed lighting figure (RL, FIGS. 10 and 11) to be connected to the power supply cable via junction cable 7 (FIG. 7) and a socket 8 (FIG. 8) carried by a circular disk 9 within the junction housing JH.

As will be described more particularly below, the junction housing JH is mounted within opening 3*a* of ceiling panel 3 by the pair of spring clamps SC in a manner which obviates the use of screws of bolt-type fasteners, and which therefore provides the many of the advantages described above.

Junction Housing Construction

Figure 1:
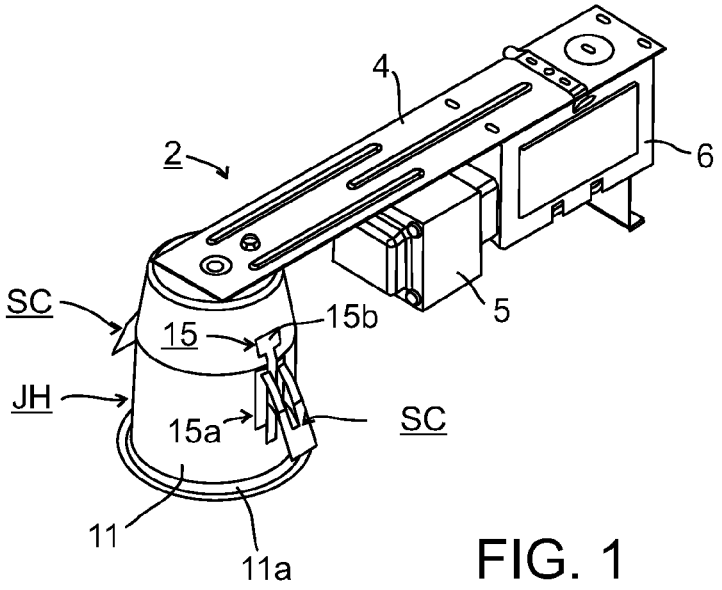
FIG. 1 is a top perspective view of an overall junction assembly constructed in accordance with the present invention particularly useful for receiving a recessed lighting fixture.
Figure 2:
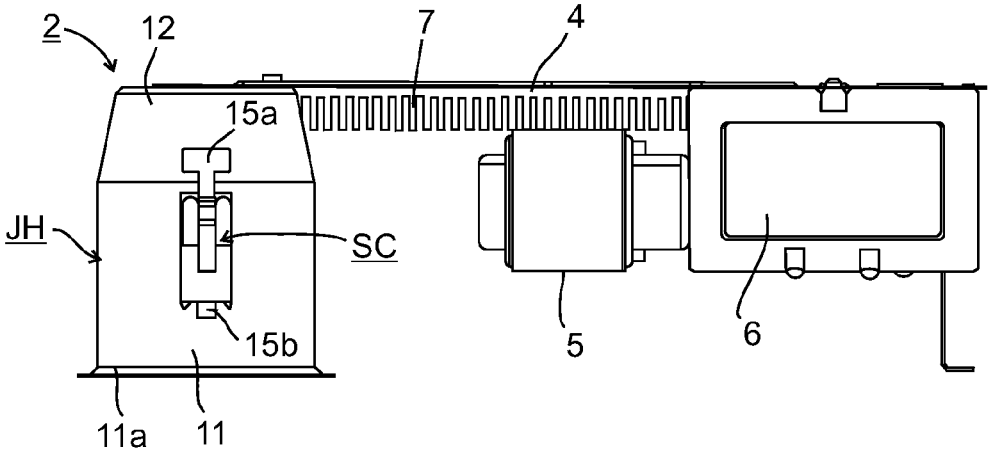
FIG. 2 is a side view of the junction assembly of FIG. 1.
Figure 3:
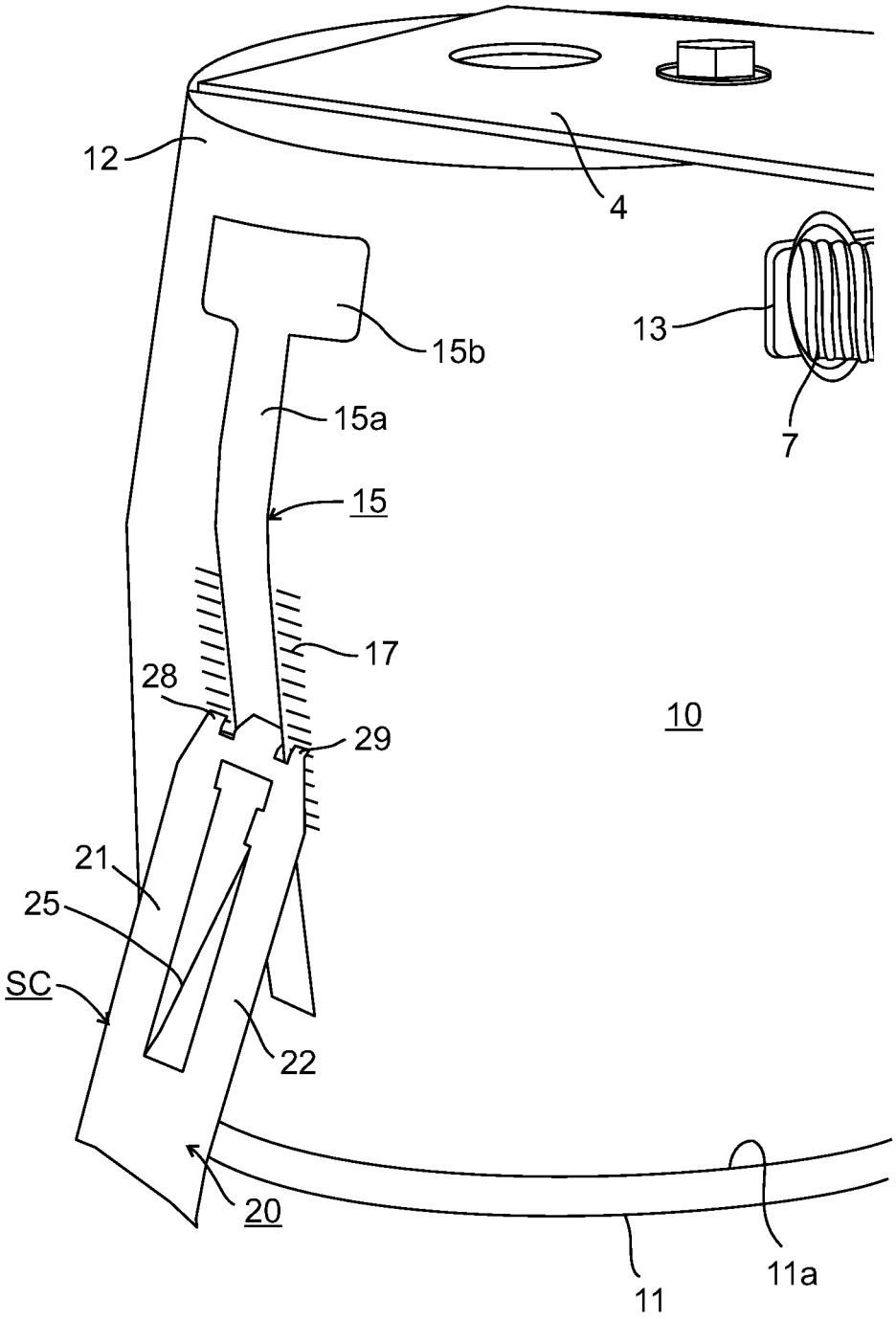
FIG. 3 is a side view of the junction housing in the assembly of FIG. 1.

The construction of the junction housing is best seen in FIGS. 3 and 4. It includes a side wall 10 of circular cross-section, open at one end 11 and closed at the opposite end 12. The open end 11 is formed with an outwardly-projection flange 11*a,* which when the housing is received within opening 3*a* in the ceiling panel 3, engages the outer surface of the ceiling panel. As will be described below, the two spring clamps SC carried by the junction housing engage flange 11*a* of the junction housing JH, and press it against the outer surface of the ceiling panel, and thereby firmly clamp the housing within opening 3*a* of the ceiling panel.

The junction housing JH is formed with an opening 13 (FIG. 3) adjacent to its closed end 12 through which the junction cable 7, within the armored jacket 14, passes into the interior of the housing where it is connected to socket 8 for receiving the lighting fixture.

The spring clamps SC are each mounted within a slot 15 formed in side wall 10 of the junction housing JH. Slot 15 is of a T-configuration, including a longitudinal (long) section extending perpendicularly to the open end 11 of the housing, and a transverse (short) section 15*b* at one end and extending perpendicularly to slot section 15*a*. As will be described more fully below, the slot sections are dimensioned so as to permit the respective spring clamp SC to be inserted into the slot and to be moved along it by a user's finger either to a locking position or a releasing position with respect to the ceiling panel 3.

Housing side wall 10 is further formed on each of its opposite side with rib-like projections 16 on its inner surface, and corresponding projections 17 on its outer surface. These projections serve as locking detents for locking the respective spring clamp in position with respect to the junction housing JH, as will be described more particularly below.

Spring Clamp Construction

Each spring clamp SC, as particularly illustrated in FIGS. 5 and 6, includes two sections, generally designated 20 and 30 respectively, integrally formed in one piece from an elastic metal sheet punched out, and bent into, the configuration illustrated in those figures. Each spring clamp is adapted to be inserted into slot 15 formed in junction housing JH such that the outer section 20 overlies the outer surface of the housing wall, and the inner section 30 underlies its inner surface, and such that both sections are movable either to a normal locking position (as illustrated in FIGS. 5 and 6), or to an actuated releasing position for releasing the junction housing from the opening within the ceiling for purposes of inspection, cleaning, repair or replacement.

The outer section 20 of each spring clamp SC includes two spaced strips 21, 22, closed at their opposite ends 23, 24, to define a closed slot between them. Outer section 20 is further formed with an elastic arm 25 integrally hinged at 26 to end 23 of the outer section, and integrally hinged at 27 to one end (32) of the inner section 30. End 23 of the outer section 20 is formed with an edge 23*a* which serves as a clamping element engageable with the inner side of the ceiling wall 3 and presses it against the outwardly-projecting flange 1 la of the junction housing JH. Edge 23*a,* preferably is formed with a tooth at each of its opposite ends to maintain housing JH in place. In addition, the spaced strips 21, 22 are formed with tabs 28, 29 at their opposite ends, to be aligned with spring arms (36, 37) integrally formed in the inner section 30. Tabs 28, 29 are also aligned with the outer rib-like detents 17 formed on the outer surface of the junction housing JH, and serve as locking teeth for the spring clamp.

Inner section 30 of each spring clamp SC includes a wall 31 having an outwardly-extending extension on the end 32 of the wall joined by integral hinge 27 to elastic arm 25. The opposite end of wall 31 is integrally formed with an arm 33 extending toward the two strips 21 and 22, and terminating in a hook 34 enclosing end 23 of the outer section 20. Wall 31 of the inner section 30 is further formed with a slot 35 which increases the elasticity or deformability of integral hinge 27 with elastic arm 25.

Inner section 30 is further integrally formed with a pair of the previously-mentioned spring arms 36, 37, on its opposite sides, each having an out-turned tip 38, 39, biasing the spring clamp to its normal position as shown in FIGS. 5 and 6. Tips 38, 39 of the spring arms are aligned with the inner rib-like detents 16 and aid the locating action produced by the locking teeth 28, 29.

As described earlier the outer and inner sections 20, 30 of each spring clamp SC are integrally formed of elastic sheet material stamped and bent to the configuration illustrated in FIGS. 5 and 6. In this configuration, wall 31 of the inner section 30 assumes an obtuse angle (i.e., over 90°) with respect to elastic arm 25 of the outer section 20. In addition, slot section 15*b* of the T-slot 15 in each side of the junction housing JH is dimensioned in length and width to permit end 32 of the inner section 30 to be passed through it to thereby locate wall 31 adjacent to the inner surface of the junction housing JH, with extension 32 spaced away from the inner surface of the junction housing. Such an arrangement thus produces a mono-stable clamp in which the locking teeth 28, 29 of the outer section 20 are biased into locking position with respect to the rib-like detents 17 formed on the outer surface on each side wall 11 of the junction housing JH. In addition, slot section 15*a* is of a width equal to the width of elastic arm 25 to guide the movements of the spring clamp within slot 15. Slot section 15*a* is of a length to permit the spring clamp to be moved in one direction to its locking position with respect to the ceiling panel 3 wherein it is locked by detents 16 and 17, or in the opposite direction to a released position wherein it is released from detents 16 and 17. In its released position, it permits removal of the junction housing JH, i.e., for inspection, cleaning, repair or replacement purposes.

Manner of Use

The manner of using the junction assembly, and particularly the two spring clamps SC, for mounting a junction housing JH within opening 3*a* in ceiling panel 3, will now be more particularly described below with respect to FIGS. 7-11.

Figure 7:
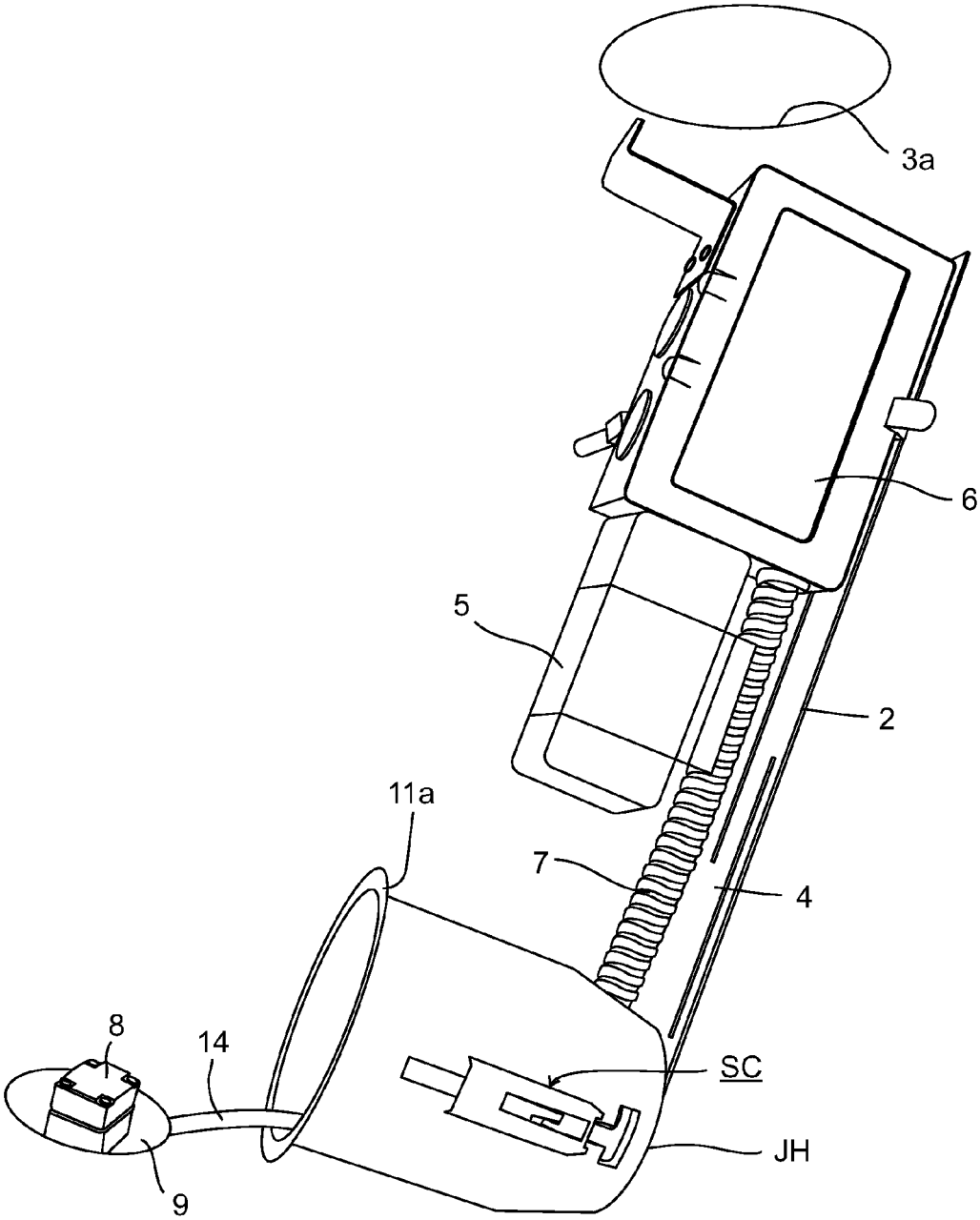
FIG. 7 illustrates the manner of introducing the junction assembly into an opening in the ceiling panel.
Figure 8:
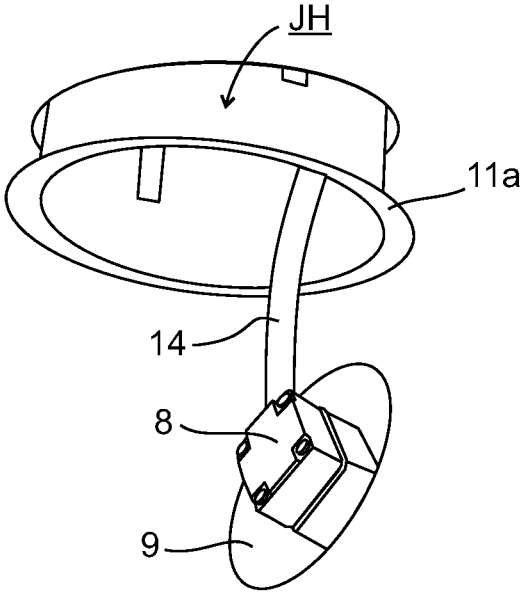
FIG. 8 illustrates the final movement of the junction assembly into the ceiling panel.

Thus, as shown in FIG. 7, the assembly is inserted through opening 3*a* in the ceiling panel 3 by first passing the connection box 6 through the opening, and then passing the junction housing JH through the opening as shown in FIG. 8. During this operation, each spring clamp is in its normal, stable locking position, with its locking teeth 28, 29 and spring-arm tips 38, 39 locked within their rib-like detents 17, and 16, respectively.

Figure 9:
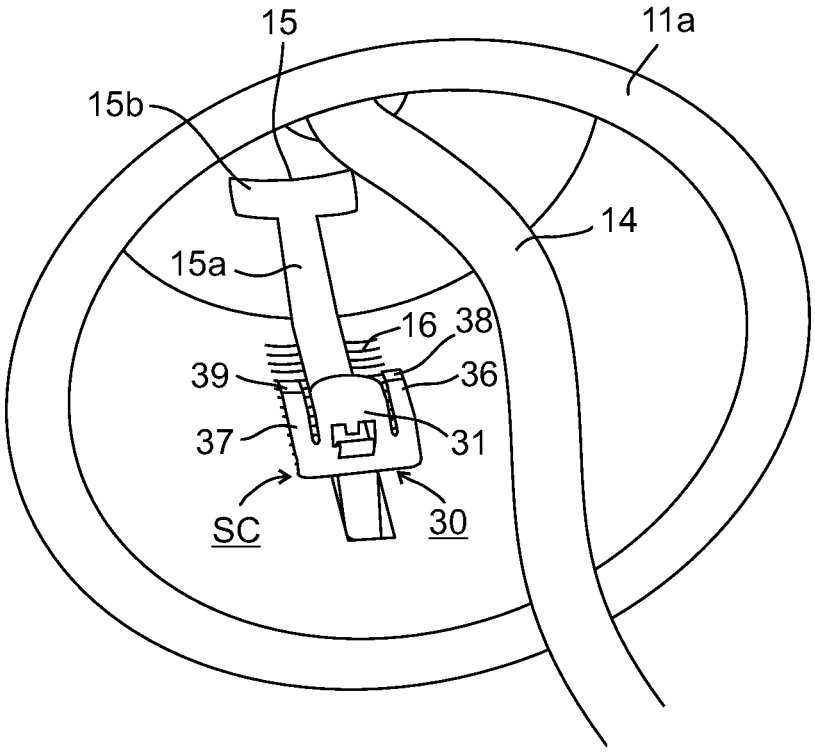
FIG. 9 illustrates the manner of actuating the spring clamp by a user's finger within the junction housing.

After the junction housing has been completely inserted through ceiling opening 3*a,* the user inserts a finger into the open end of the junction housing JH, as seen in FIG. 9, and engages end 32 of the inner section 30. As described above, end 32 serves as a finger-engageable element which is spring-biased away from the inner surface of the junction housing wall with the locking teeth 28, 29 and spring-arm tips 38, 39 pressed into locking engagement with the rib-like detents 17 and 16, respectively. The mono-stable condition of each spring clamp is thus a locking position.

As further shown in FIG. 9, when finger-engageable element 32 is pressed towards the inner surface of the junction housing wall, the two spring arms 36, 37 are rocked away from the junction housing wall. This causes spring-arm tips 38, 39 to be withdrawn from their respective inner-surface detents 16, and also causes locking teeth 28, 29 to be withdrawn from their respective outer-surface detents 17. The respective spring clamp SC is thus released for movement in either direction. That is, it may be moved in the direction of the housing open end 11, to cause clamping teeth 23*a* to engage the inner surface of ceiling wall 3 and to clamp the junction housing JS to the ceiling wall 3, or it may be moved in the opposite direction to disengage clamping teeth 23*a* from the junction housing, thereby permitting the junction housing to be removed for inspection, cleaning, repair or replacement purposes.

It will thus be seen that each spring clamp SC acts as a mono-stable clamp, in which it has one stable position, namely the clamping position. It will also be seen that in this mono-stable clamping position, clamping teeth 23*a* dig into this inner surface of the ceiling panel, and thereby hold the junction housing JH against removal or turning therein.

Figure 10:
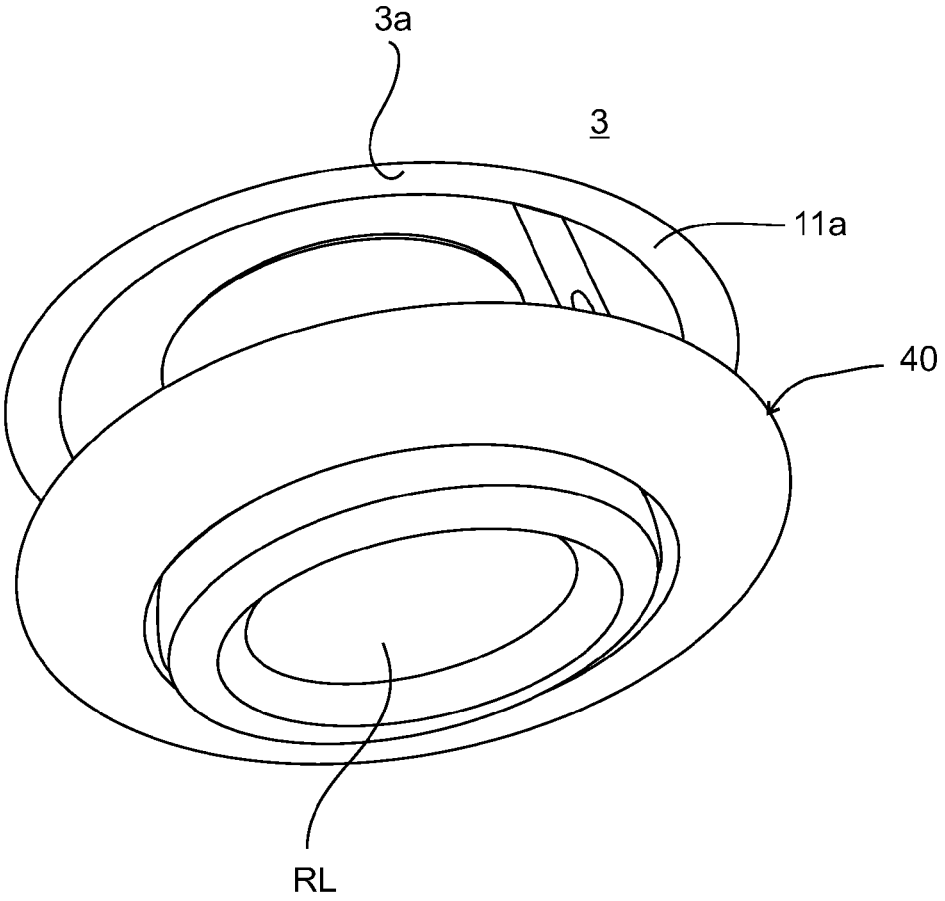
FIG. 10 illustrates the attaching of a trim member after the junction assembly has been introduced into the opening in the ceiling panel.
Figure 11:
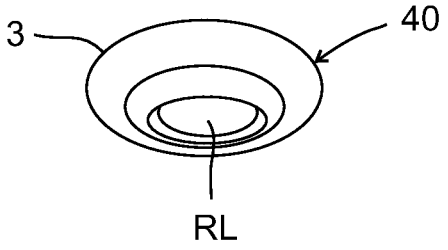
FIG. 11 illustrates the final appearance of the recessed lighting fixture when attached to the ceiling panel.

After the housing fixture has been clamped within the ceiling panel as described above, a conventional trim member, such as shown at 40 in FIGS. 10 and 11, may then be applied to provide an attractive trim around the light fixture RL, and also to hold the light fixture within the junction housing. Various types of trim members 40 are known and usable for this purpose.

Variations and Other Applications

While the invention has been described with respect to one preferred embodiment, namely for use in mounting a recessed lighting fixture in a ceiling panel, it will be appreciated that the invention could be used in many other applications. For example, it could be used for mounting another type of electrical device, e.g., a socket for an electrical fan, a ventilator outlet, or the like, in a ceiling panel, a sidewall panel, or the like. It can also be used with various types of trim members. Many other variations, modifications and applications of the invention will be apparent.

What is claimed is:

1. An attaching device for use in releasably attaching a housing to a wall panel, the housing being formed with an open end circumscribed by an outwardly projecting flange, the wall panel being formed with an opening sized for receiving the housing with the flange engaging an outer surface of the panel, said attaching device serving as a spring clamp, comprising:

an outer section to be located over, and to be movable along, an outer surface of the housing when the housing is received, with the spring clamp attached thereto, within said opening in the panel;

and an inner section to be located proximate to, and to be movable along, an inner surface of the housing when the housing is received, with the spring clamp attached thereto, within said opening in the panel;

said inner section including a finger-engageable element spring-biased to a locking position for locking the housing onto the panel, but engageable by a user's finger to move the spring clamp to a releasing position releasing the housing for movement within the panel to a locking or releasing position with respect to the housing;

wherein said outer section includes: an outer wall formed with a pair of parallel, spaced arms joined together at their opposite ends to define a closed slot; an elastic arm integrally joined at one end to one end of said outer section and of the same width as said closed slot; a first coupling the opposite end of said elastic arm to one end of said inner section; and a second coupling the opposite end of said inner section to the opposite end of said outer section.

2. The attaching device according to claim 1, wherein said attaching device includes two of said spring clamps, one on each side of said housing.

3. The attaching device according to claim 1, wherein said finger-ngageable element is located spaced from the outer surface of the housing when the attaching device is attached thereto, and is depressible towards said inner surface to define a monostable clamp for releasably attaching the housing within said opening in the wall panel.

4. The attaching device according to claim 1, wherein said inner section includes an inner wall elastically coupled at said one end by said first coupling to said elastic arm at an obtuse angle to said elastic arm, to thereby produce said monostable clamping action.

5. The attaching device according to claim 4, wherein said inner section further includes at least one spring arm biasing said finger-engageable element to its locking position.

6. The attaching device according to claim 5, wherein said inner section is integrally formed with a pair of said spring arms.

7. The attaching device according to claim 6, wherein said outer section further includes a clamping element engageable with the inner surface of the panel adjacent said opening therein for clamping the housing within the panel.

8. The attaching device according to claim 7, wherein said clamping element is defined by an outer edge of said outer section.

9. The attaching device according to claim 8, wherein said outer section includes at least one locking tooth engageable with one of a plurality of locking detents formed on the outer surface of the housing for locking the housing within the opening in the panel.

10. The attaching device according to claim 8, wherein said outer section is integrally formed at its opposite ends with a pair of said locking teeth.

11. The attaching device according to claim 10, wherein said inner and outer sections are integrally formed as a single integral unit.

12. A junction assembly including an attaching device according to claim 11, in combination with a housing formed with an open end circumscribed by an outwardly projecting flange, said housing being further formed with a slot in at least one side thereof for receiving said attaching device in a manner such that the finger-engageable element is spring-biased to a locking position for locking the housing within the panel, but is engageable by a user's finger to move the attaching device to a releasing position releasing the housing for movement within the panel to a locking or releasing position with respect thereto.

13. The junction assembly according to claim 12, wherein said slot is of a T-configuration, including a longitudinal section extending perpendicularly to said open end of the housing and terminating short of said housing side wall, and a transverse section extending perpendicularly to said longitudinal section.

14. The junction assembly according to claim 13, wherein said longitudinal section of said slot in the housing is of a width equal to that of the elastic arm of said outer section of the attaching device to guide the movement of the attaching device.

15. The junction assembly according to claim 14, wherein and said transverse section of said slot is of a length at least equal to that of said inner section of the attaching device to permit the attaching device to be movably received within said slot.

16. The junction assembly according to claim 15, wherein said housing is further formed with rib-like detents on its outer surface engageable by said locking teeth on said outer section, and similar rib-like detents on said inner surface engageable by similar locking teeth on said inner section, for locking the attaching device in its locking or releasing condition.

17. The junction assembly according to claim 12, wherein said housing is closed at the end thereof opposite to said open end.

18. The junction assembly according to claim 12, wherein said housing is formed with one of said slots in each of two opposite side walls of the housing for receiving one of said attaching devices.

19. The junction assembly according to claim 12, wherein said housing is carried at one end of a mounting member; and wherein said mounting member further carries: an armored cable enclosing a junction cable; a connection box carried at the opposite end of said mounting member; and a transformer connected at one side to a power supply cable, and at the opposite side to an electrical socket within said housing.

* * * * *